United States Patent [19]

Miyakawa et al.

[11] 4,035,071

[45] July 12, 1977

[54] DEVELOPING PROCESS AND APPARATUS FOR ELECTROPHOTOGRAPHY

[75] Inventors: Seiichi Miyakawa, Nagareyama; Akira Midorikawa, Yokohama, both of Japan

[73] Assignee: Ricoh Co., Ltd., Japan

[21] Appl. No.: 624,843

[22] Filed: Oct. 22, 1975

[30] Foreign Application Priority Data

Oct. 24, 1974 Japan ..... 49-122670

[51] Int. Cl.[2] ..... G03G 15/10

[52] U.S. Cl. ..... 355/10

[58] Field of Search ..... 355/3 TR, 3 DD, 3 P, 355/3 R, 10, 17; 354/3

[56] References Cited

U.S. PATENT DOCUMENTS

| | | | |
|---|---|---|---|
| 2,877,133 | 3/1959 | Mayer | 355/17 |
| 3,782,818 | 1/1974 | Smith | 355/10 |
| 3,850,662 | 11/1974 | Jahn | 355/3 DD X |
| 3,879,120 | 4/1975 | Kurokawa et al. | 355/3 R |

*Primary Examiner*—Donald A. Griffin
*Attorney, Agent, or Firm*—McGlew and Tuttle

[57] ABSTRACT

A developing process for electrophotography and an apparatus for carrying out the process in which a developing electrode is arranged in opposing relationship with a photoconductive member having an electrostatic latent image formed thereon such that a potential corresponding to an average potential of the latent image is produced on the electrode by either induction or resistor chain. The potential on the electrode is, however, controlled so as to be maintained, through a constant voltage element such as a varistor, above a given voltage slightly higher than, or equal to, the lowest potential on at least a portion of the member which is assumable in forming any type of latent images on the member so as to reproduce copies of good quality even from a very light or low density image on an original document to be copied. The electrode potential can be further controlled through a varistor, for example, to be prevented from rising above another given voltage considerably higher than the first mentioned voltage so that good quality copies are reproduced even for an original having a colored background or larger proportion of black image regions.

7 Claims, 4 Drawing Figures

DEVELOPING PROCESS AND APPARATUS FOR ELECTROPHOTOGRAPHY

BACKGROUND OF THE INVENTION

The invention relates to a developing process for use in the electrophotography.

A developing process of self-bias type for use in the electrophotography is known in which in the region of a photosensitive member where a developing agent is to be supplied, a developing electrode is disposed in opposing relationship therewith with a spacing on the order of several millimeters or less. In the developing process of this type, an electric potential of the same polarity but of a reduced magnitude from that of an electrostatic latent image formed on the photosensitive member is produced on the developing electrode by either induction or through a resistor chain. The magnitude of the potential depends on the spacing between the photosensitive member and the developing electrode, the configuration of the electrode, the material used as the developing solution and the potential of the latent image on the photosensitive member. Assuming a xerographic process in which selenium is employed as a photosensitive member and is subjected to a wet developing process, a material to be copied, which is generally white with a substantial reduced proportion of image area, will yield a potential of about 50 volts substantially allover, the surface of the photosensitive member and a potential of about 20 volts on the developing electrode. A toner contained in the developing solution will be attracted toward the photosensitive member which has a higher potential than the developing electrode, so that regions of the copy which should remain white are slightly marred, causing an overall background smearing. On the contrary, where the background of the material to be copied is colored, for example, in a yellow or blue color, or, where the proportion of the image region is increased, the developing electrode may assume a potential as high as 600 volts when the potential of the latent image on the photosensitive member is on the order of 1000 volts, producing a difference in the potential therebetween on the order of 400 volts. This is low enough to cause a virtual degradation in the developing effect by producing a very light or low density copy image.

It is also known to electrically ground the developing electrode. While this scheme increases the image density, the residual potential of the photosensitive member, or the potential of regions of the photosensitive member which correspond to the white background of the material to be copied will be influenced by the surface potential of the exposed regions, again causing a background smearing.

It is also known to apply a fixed bias potential to the developing electrode, but a low bias potential results in a background smearing while a high bias potential degrades the developing effect, resulting in either one of the disadvantages mentioned above.

SUMMARY OF THE INVENTION

It is an object of the invention to provide a developing process for electrophotography which eliminates the background smearing and the reduction in developing effect.

DETAILED DESCRIPTION OF EMBODIMENTS

Figure 1:
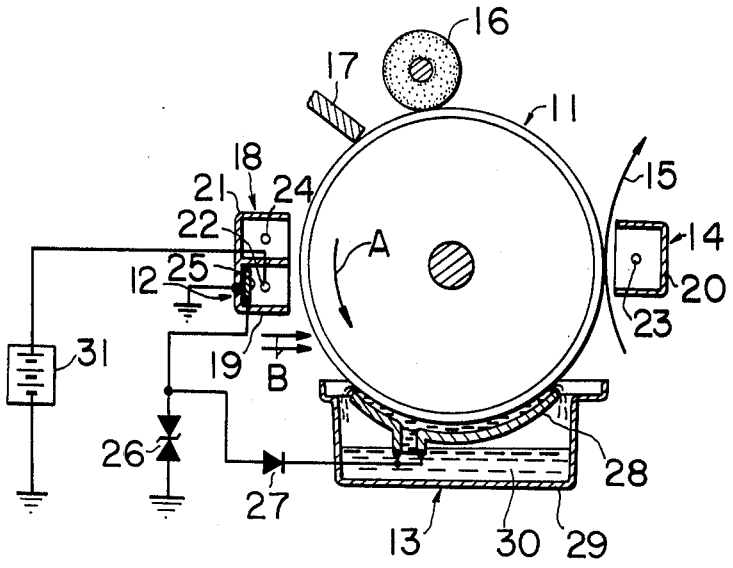
FIG. 1 is a schematic view of one embodiment of the invention.

Referring to FIG. 1, there is shown a photosensitive member 11 which is in the form of a drum and is driven at a uniform speed in the direction indicated by an arrow A by suitable drive means. As it rotates, the photosensitive member 11 is charged by a corona discharger 12, and exposed to a light image from a material to be copied, as indicated by arrows B, which is directed from an exposure unit to form an electrostatic latent image thereon, which is then developed by a developing unit 13 and transferred by a transfer unit comprising a corona discharger 14 onto a transfer sheet 15. Subsequently, the drum is cleaned by a cleaning unit which comprises a roller 16 and a blade 17, and is then discharged by a corona discharger 18. After transfer, the image on the transfer sheet 15 is fixed by a fixing unit, not shown, and then delivered as a copy sheet externally of the machine.

Figure 2:
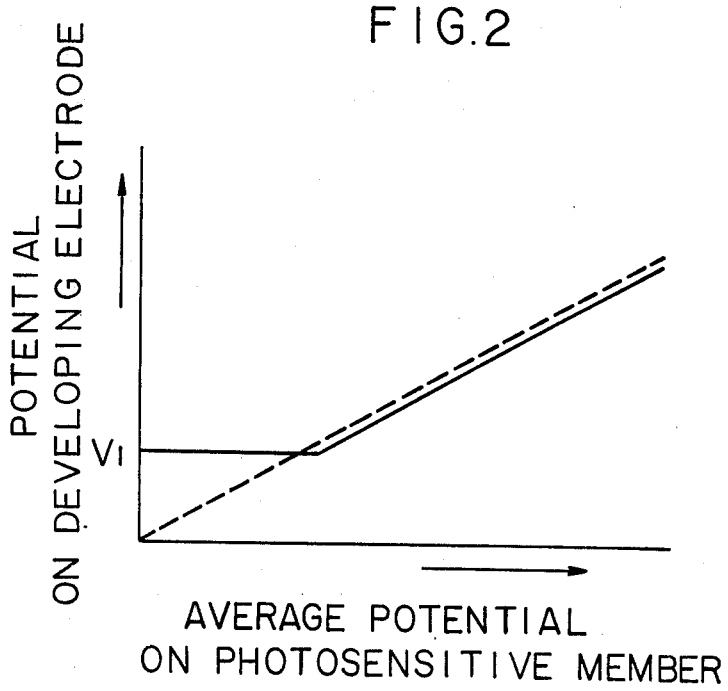
FIG. 2 graphically illustrates the operation of the apparatus shown in FIG. 1.

Each of the corona dischargers 12, 14 and 18 comprises a shield frame 19, 20 or 21 in which a wire electrode 22, 23 or 24 is disposed. The output of a high voltage source is applied to the wire electrodes 22 to 24. The corona discharger 12 which serves to charge the photosensitive member includes a conductive plate 25 which is located within the shield frame 19. A varistor 26 which functions as a constant voltage element is connected between the conductive plate 25 and the ground, and the junction between the conductive plate 25 and the varistor 26 is connected through a forwardly poled rectifier 27 with a developing electrode 28 of the developing unit 13. The developing electrode 28 is disposed in opposing relationship with the lower portion of the photosensitive member 11 with a spacing on the order of several millimeters or less therebetween. The developing unit 13 also includes a developing vessel 29 which contains a supply of developing solution 30, which is pumped into the space between the photosensitive member 11 and the developing electrode 28 for the purpose of developing. A potential corresponding to the potential of the latent image of the photosensitive member 11 or to its average surface potential will be produced on the developing electrode 28 by either induction or resistor chain, as indicated in broken lines in FIG. 2, permitting a satisfactory copying operation without producing a background smearing. A corona discharge current flows from the wire electrode 22 to the conductive plate 25 and thence through the varistor 26, thus producing a given voltage $V_1$ thereacross. The voltage $V_1$ is applied through the rectifier 27 to the developing electrode 28, whereby its potential is controlled above the given voltage $V_1$ as shown in solid line in FIG. 2. Considering this aspect in further detail, it will be appreciated that even if the potential of the latent image on the photosensitive member 11 in the region of the black images, that is, the surface potential in the regions exposed to black image portions of the material to be copied remains at a given value, for example, 1000 volts, regardless of the area of the image regions, the potential of the latent image in the white regions, namely, the surface potential in the regions which are exposed to the white background area of the material to be copied, will be lower than the potential of the black regions because of the contrast in the material being copied, so that the average potential of the photosensitive member 11 will vary with the area of black image regions on the material being copied, with a corresponding change in the potential of the developing electrode 28. By choosing the bias potential $V_1$ applied to the developing electrode 28 to be slightly higher than or equal to the potential of the latent image on the photosensitive member 11 in its white regions or a value which is modified in consideration of an increase in such potential which occurs as a result of a fatigued photosensitive member, the background smearing can be avoided even if the material being copied is entirely white colored.

Figure 3:
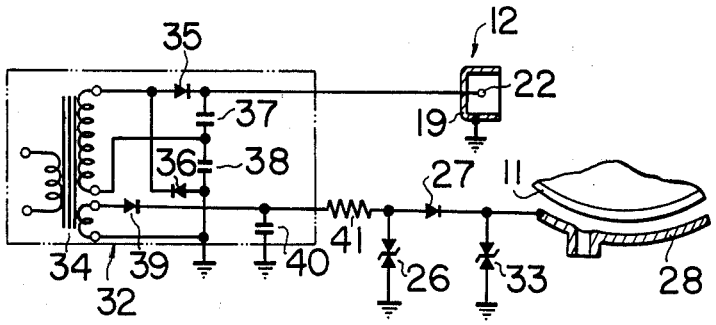
FIG. 3 is a schematic view of the essential parts of another embodiment of the invention.
Figure 4:
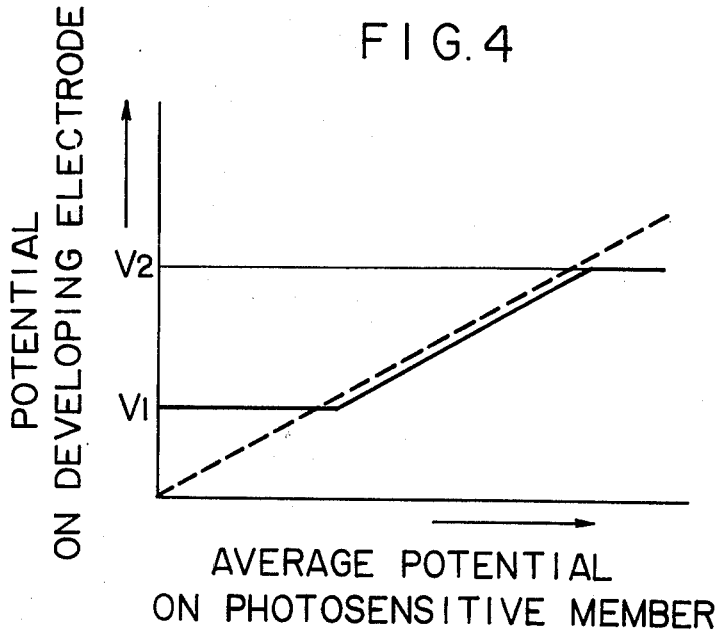
FIG. 4 graphically illustrates the operation of the apparatus shown in FIG. 3.

FIG. 3 shows another embodiment of the invention. Specifically, a high voltage source 32 supplies current to the varistor 26, and another constant voltage element or varister 33 is connected between the developing electrode 28 and the ground. The high voltage source 32 comprises a transformer 34 which steps up the output of a commercial a.c. power supply, the output from a first secondary winding thereof being applied across a voltage doubler comprising a pair of diodes 35 and 36 and a pair of capacitors 37, 38. The output of the voltage doubler is rectified to be applied to the wire electrode 22 of the corona discharger 12. The output from a second secondary winding of the transformer 34 is rectified by a diode 39 and smoothed by a capacitor 40 to be fed to the varister 26 through a resistor 41. When the potential of the developing electrode 28 tends to rise above a given voltage $V_2$ as indicated in solid line in FIG. 4, the varister 33 becomes operative to limit the voltage thereacross to the given voltage $V_2$. As a result, the increase of the potential of the developing electrode 28 above the given potential $V_2$ is avoided to thereby avoid a degradation in the image density for a material being copied which has a colored background or having a large proportion of image regions. The value of the potential $V_2$ is chosen in accordance with a darkness level of the material being copied which should be reproduced as a white background.

The varistor 26 may be fed with current from another corona discharger in order to prevent the precipitation of toner onto the developing electrode 28 by utilizing the on and off timing of the corona discharger. In addition, the varistor 26 may be replaced by a d.c. source. The self-bias technique mentioned above may be modified by an auto-bias technique in which the surface potential of the photosensitive member is detected to apply a potential to the developing electrode which depends on the detection output. It should be also understood that the invention is equally applicable to a dry developing process.

What is claimed is:

1. A developer for electrophotography, comprising a drum having a curved photosensitive surface adapted to be impressed with a latent electrostatic image, a curved electrode plate arranged in closely spaced relationship to said drum photosensitive surface, means for impressing voltage on said electrode, and control means for controlling the voltage so that it has a potential at least equal to the lowest potential on the photosensitive surface, and means for supplying a developing solution between said electrode and said photosensitive surface, the developer including a liquid developer reservoir, said curved plate having an opening therethrough, and means for circulating liquid through said opening and permitting it to overflow on each side into said reservoir.

2. A developer for electrophotography, comprising a drum having a curved photosensitive surface adapted to be impressed with a latent electrostatic image, a curved electrode plate arranged in closely spaced relationship to said drum photosensitive surface, means for impressing a voltage on said electrode, and control means for controlling the voltage so that it has a potential at least equal to the lowest potential on the photosensitive surface, and means for supplying a developing solution between said electrode and said photosensitive surface, said control means further comprising a first constant voltage element connected between a current source and a ground, the junction between said constant voltage element and said current source being connected to said electrode plate through a forwardly biased rectifier.

3. A developer according to claim 2, further comprising a discharger adjacent a portion of said photosensitive surface for charging said surface, having a wire electrode connected to a high d.c. voltage source and having a shield member partially surrounding said wire electrode and facing said surface, said shield being connected to a ground, said current source further comprising a conductive plate disposed within said shield adjacent said wire electrode.

4. A developer according to claim 2, wherein said control means further comprises means for maintaining the voltage impressed on said electrode plate below the higher potential of said patent electrostatic image produced on said surface by a light image with dark image areas.

5. A developer according to claim 4, wherein said voltage maintaining means comprises a second constant voltage element connected between said electrode plate and a ground.

6. A developer according to claim 5, wherein said second constant voltage element is a varistor.

7. A developer according to claim 2, wherein said first constant voltage element is a varistor.

* * * * *